United States Patent [19]

Bouillon et al.

[11] Patent Number: 4,562,671

[45] Date of Patent: Jan. 7, 1986

[54] LENS HOLDING SPINDLE FOR A LENS GRINDING MACHINE

[75] Inventors: Serge Bouillon, Creteil; Jean-François Cailloux, Le Raincy; Christian Chevalier, Vincennes, all of France

[73] Assignee: Essilor International (Compagnie Generale d'Optique), France

[21] Appl. No.: 583,579

[22] Filed: Feb. 24, 1984

[30] Foreign Application Priority Data

Mar. 7, 1983 [FR] France ..... 83 03674

[51] Int. Cl.[4] ..... B24B 41/04

[52] U.S. Cl. ..... 51/216 LP; 51/235

[58] Field of Search ..... 51/216 LP, 217 L, 235, 51/237 R; 279/3, 7

[56] References Cited

U.S. PATENT DOCUMENTS 1,624,658 4/1927 Devine ..... 51/216 LP
1,952,212 3/1934 McCabe ..... 51/216 LP
3,079,736 3/1963 Kratt ..... 51/237 R
3,410,031 11/1968 Soong ..... 279/7

*Primary Examiner*—Harold D. Whitehead

[57] ABSTRACT

A lens holding spindle for grinding machines is provided comprising two substantially cylindrical elements mounted concentrically one inside the other, one of the two elements forming the body of the spindle intended to be fixed to the grinding machine, the other element comprising, at one of its ends, a recess for receiving a metal block fixed to one face of a lens, the other face of which is to be ground; the body of the spindle is the inner cylindrical element which comprises an end portion which projects axially inside the recess of the external cylindrical element and which has an end face forming both a fixed reference and an axial bearing surface for the lens to be ground; the external cylindrical element is mounted for sliding on the inner cylindrial element; clamping means mounted on one of said two cylindrical elements for clamping the other of the two cylindrical elements.

8 Claims, 4 Drawing Figures

LENS HOLDING SPINDLE FOR A LENS GRINDING MACHINE

BACKGROUND OF THE INVENTION

1. Field of the Invention

The present invention relates to a lens holding spindle for a grinding machine, comprising two substantially cylindrical elements mounted concentrically one inside the other and movable axially with respect to each other, the outer cylindrical element comprising at one end a recess for receiving a lens to be ground and a support for said lens, the inner cylindrical element comprising an end portion which extends axially and which comprises an endmost face engageable with one face of the lens to be ground, one of the two elements forming the body of the spindle to be fixed to the grinding machine, and clamping means mounted on one of the two cylindrical elements and operable, when actuated, to clamp the other of said two elements.

2. Description of the Prior Art

Lens holding spindles are used for example in machines for grinding spherical or toric, concave or convex surfaces on different materials such as mineral or organic glasses. Such a machine and its lens holding spindle are described for example in French Pat. No. 1 445 5122 (see also-U.S. Pat. Nos. 1,952,212, 2,879,632, 3,237,349, and 3,410,031). As is illustrated schematically in FIG. 1 of the accompanying drawings, known machines comprise essentially a lens holding spindle 1 which is movable in translation along its longitudinal axis as shown by the double arrow $F_1$ and in rotation about a shaft 2, perpendicular to the plane of the Figure, as shown by the doubled curved arrow $F_2$. Shaft 2 is fixed with respect to the frame of the machine and is in general vertical. The machine further comprises a rotary spindle 3 with horizontal axis, which supports at one end a grinding wheel 4 and which is movable in translation both in the direction of its longitudinal axis as shown by the double arrow $F_3$ and in a direction perpendicular to its longitudinal axis as shown by the double arrow $F_4$. The mechanisms for obtaining the above mentioned movements of spindle 1 and spindle 3 are not shown in FIG. 3 to the extent that they are fully described in the above mentioned French patent to which reference may be made for further details. It will simply be noted that these mechanisms comprise sliding carriages with which graduated scales forming verniers are associated, which allows the position of spindle 1 to be adjusted and set with respect to shaft 2 (dimension Z) and the position of the grinding wheel 4 with respect to shaft 2 (dimensions X and Y).

Spindle 1 comprises, in its end adjacent grinding wheel 4, a truncated cone shaped recess 5 which receives the shank 6, also in the form of a truncated cone, of a lens holder 7 which supports the lens 8 to be ground. In the case where the lens 8 is a semi-finished ophthalmic lens, i.e. a lens one 8*a* of the two faces 8*a* and 8*b* of which has already been ground and polished and whose other face 8*b* must be ground to a spherical or toric shape having the prescribed curvature or curvatures, the ophthalmic lens 8 is mounted in the lens holder 7 by means of a metal block 9, also called "molette" which is molded and bonded to the finished face 8*a* of the ophthalmic lens 8. For a grinding wheel 4 of a given shape and dimensions, adjustment of dimensions X and Y allows the desired toric or spherical surface to be obtained when spindle 1 and the ophthalmic lens 8 are caused to pivot about shaft 2. Adjustment of the position of spindle 1 in the direction of the double arrow $F_1$ (dimension Z) determines the thickness e at the center of the ophthalmic lens 8.

However, with the lens holding spindle described in French Pat. No. 1,445,552, although the dimension Z is perfectly known and may be accurately adjusted, the distance d between the apex S of the finished face 8*a* of lens 8 and the front face of spindle 1 is generally unknown. This distance d depends on several factors such as the curvature of the finished face 8*a* of lens 8, the thickness of the metal block 9, the accuracy of mounting the metal block 9 in the lens holder 7, the degree of penetration of the shank 6 of the lens holder 7 in the truncated cone shaped recess 5 of spindle 1. Some of these factors can not be measured and/or reproduced from one grinding operation to the next. This compels the operator to carry out grinding of face 8*b* of lens 8 in two stages. In a first stage, the operator adjusts dimension Z to a first value $Z_1$ and effects a first grinding pass. Then, he removes the ophthalmic lens 8 from the lens holder 7 and measures the thickness at the center of lens 8. If $e_1$ designates the thickness thus measured and $e_2$ the desired thickness ($e_2 < e_1$), the operator then adjusts Z to the value $Z_2$ so that:

$$Z_2 = Z_1 - (e_1 - e_2)$$

and he then effects a second grinding pass so as to obtain the desired thickness at the center of lens 8. Such a method of operating, which requires removal of the ophthalmic lens 8 and measurement of the thickness at its center between two grinding passes, represents a waste of time which adversely effects the productivity of the machine. Furthermore, the thickness effectively obtained at the center of lens 8 after the second grinding pass may be erroneous if, before the second machining pass, lens 8 is not mounted again on spindle 1 exactly in the same axial position as the one it occupied during the first grinding pass.

The above observations are also valid in the case of the lens holding spindles described in U.S. Pat. Nos. 2,879,632, 3,237,349 and 3,410,031.

With the machine described in U.S. Pat. No. 1,952,212 the axial position of the lens holding spindle may be adjusted so as to obtain the final thickness desired at the center of the lens without intermediate measurement of this thickness during grinding. However, this result is obtained by means of a relatively complex mechanical structure, which impairs the accuracy of positioning of the lens and which is difficult to protect from the projections of water and glass particles produced during grinding. Furthermore, so as to be able to go over from grinding of a concave surface to that of a convex surface, it is necessary to reverse the relative positions of the lens and of the elements of the lens holding spindle, which complicates handling of the grinding machine. Finally, the structure described in U.S. Pat. No. 1,952,212 is difficult to adapt to a digitally controlled grinding machine.

SUMMARY OF THE INVENTION

The object of the invention is to provide an improved lens holding spindle allowing the desired thickness to be obtained at the center of an ophthalmic lens without removal of the ophthalmic lens and without intermediate measurement of the thickness at its center during grinding, by a simple initial adjustment of the position of the lens holding spindle, i.e. by a simple initial adjustment of the above mentioned dimension Z.

The lens holding spindle of the present invention is characterized in that the inner cylindrical element forms the body of the spindle and the endmost face of its end portion forms both a fixed reference and an axial support for the lens to be ground, and the outer cylindrical element is slidably mounted on the inner cylindrical element.

BRIEF DESCRIPTION OF THE DRAWINGS

The invention will be better understood from reading the following description with reference to the accompanying drawings in which.

DESCRIPTION OF THE PREFERRED EMBODIMENT

Figure 3:
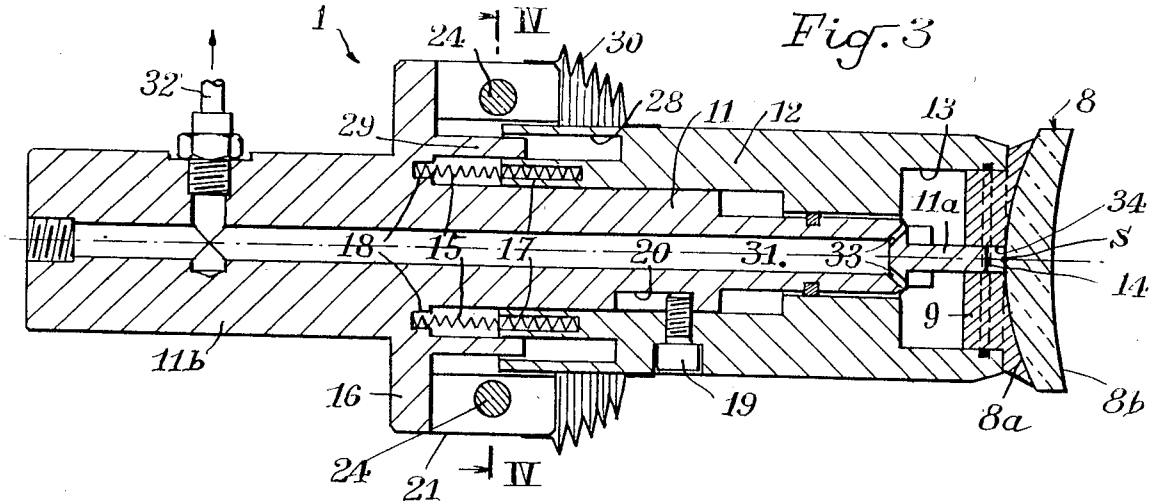
FIG. 3 is an axial sectional view of one embodiment of the lens holding spindle of the present invention.
Figure 4:
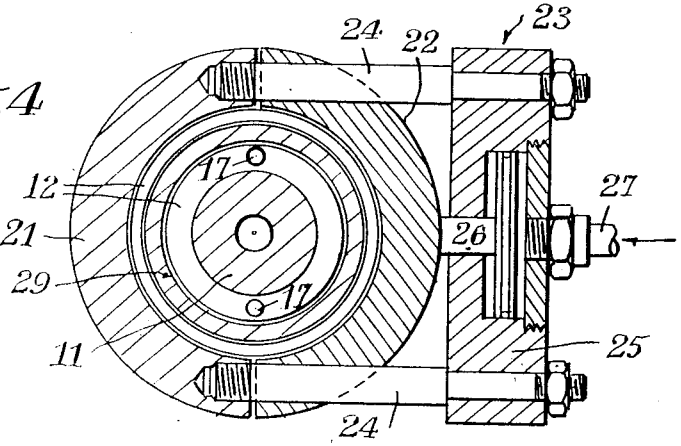
FIG. 4 is a cross sectional view along line 4—4 of FIG. 3.

The lens holding spindle shown in FIGS. 3 and 4 comprises a body 11, cylindrical in shape, on which a sleeve 12 is slidably mounted. At one end thereof, sleeve 12 has a recess 13 adapted to receive the metal block or "molette" 9 to which is fixed the ophthalmic lens 8 to be ground. Recess 13 may have a cylindrical or polygonal shape, or other indexing means may be provided in a way known per se between sleeve 12 and the metal block 9 for indexing the angular position of the ophthalmic lens 8 with respect to the axis of spindle 1 when a toric surface is to be ground on the face 8*b* of said lens.

Body 11 comprises an end portion 11*a* which projects axially inside recess 13 and which has an end face 14 forming both a fixed reference and an axial bearing surface for the face 8*a* of the ophthalmic lens 8 as will be seen further on. As shown in FIG. 3, the end face 14 is flat and perpendicular to the longitudinal axis of body 11, but this face would have another shape, for example the shape of a truncated cone or the shape of a sphere portion.

The lens holding spindle 1 further comprises a resilient means mounted between body 11 and sleeve 12 for urging this latter to a rest position in which the end face of sleeve 12 is offset axially outwardly with respect to the end face 14 of end portion 11*a* of body 11. As shown in FIG. 3, the above mentioned resilient means may be formed for example by two helical compression springs 15, one end of which bears on the other end of sleeve 12, opposite that which comprises recess 13, and the other end of which bears on a circular flange 16 integral with an end portion 11*b* of body 11 which extends axially outwardly beyond said other end of sleeve 12. Preferably, the ends of the two springs 15 are engaged in blind holes 17 and 18 bored respectively in said other end of sleeve 12 and in said circular flange 16. Stopping means are provided for limiting the axial movement of sleeve 12 with respect to body 11 under the effect of springs 15 and for thus defining the above mentioned rest position. As shown in FIG. 3, the stopping means may be formed for example by a screw 19 supported by sleeve 12, which projects radially inwardly and which is engaged in a slit 20 formed longitudinally in the cylindrical surface of body 11.

The lens holding spindle 1 further comprises clamping means for clamping sleeve 12 with respect to body 11 in the desired position as can be seen further on. As shown in FIGS. 3 and 4, these clamping means may be formed for example by two jaws 21 and 22, which are supported by body 11 and which clamp round sleeve 12, and by an actuating means 23 associated with the two jaws so as to move them one towards the other. Each of the two jaws 21 and 22 has preferably an approximately semi cylindrical shape. Jaw 21 is fixed rigidly to the flange 16 of body 11, whereas jaw 22 is mounted for sliding in the radial direction on two guide rods 24 which extend perpendicular to the joining plane of the two jaws 21 and 22 on each side of body 11 and which are fixed, at one of their ends, to jaw 21. As shown in FIG. 4, the actuating means 23 may be formed for example by a pneumatic cylinder whose body 25 is fixed to the other end of the two guide rods 24 and whose piston rod 26 bears against jaw 22 substantially in the middle of its semi cylindrical outer surface. The pneumatic cylinder 23 is connected by a flexible pipe 27 to a compressed air source (not shown).

So as to protect the surfaces of body 11 and sleeve 12 which are in sliding contact, against the cooling liquid used in the grinding machine for cooling the grinding wheel and the ophthalmic lens 8 and against the mineral or organic glass particles removed by the grinding wheel during grinding, sleeve 12 comprises, in its end opposite recess 13, a cylindrical annular cavity 28 into which is engaged a cylindrical collar 29 which is integral with flange 16 and which forms with cavity 28 a labyrinth seal. So as to further improve the seal and also to protect the active surfaces of jaws 21 and 22, a sealing bellows 30 may be further mounted between the two jaws 21 and 22 on the one hand, and sleeve 12 on the other, as shown in FIG. 3.

In addition, the metal block 9 with the ophthalmic lens 8 which is fixed thereto may be held in position in recess 13 of sleeve 12 in a way known per se by suction. To this end, body 11 comprises an axial passage 31 which is connected by a flexible pipe 32 to a suction source (not shown) and which opens through oblique passages 33 into the recess 13 of sleeve 12.

Figure 1:
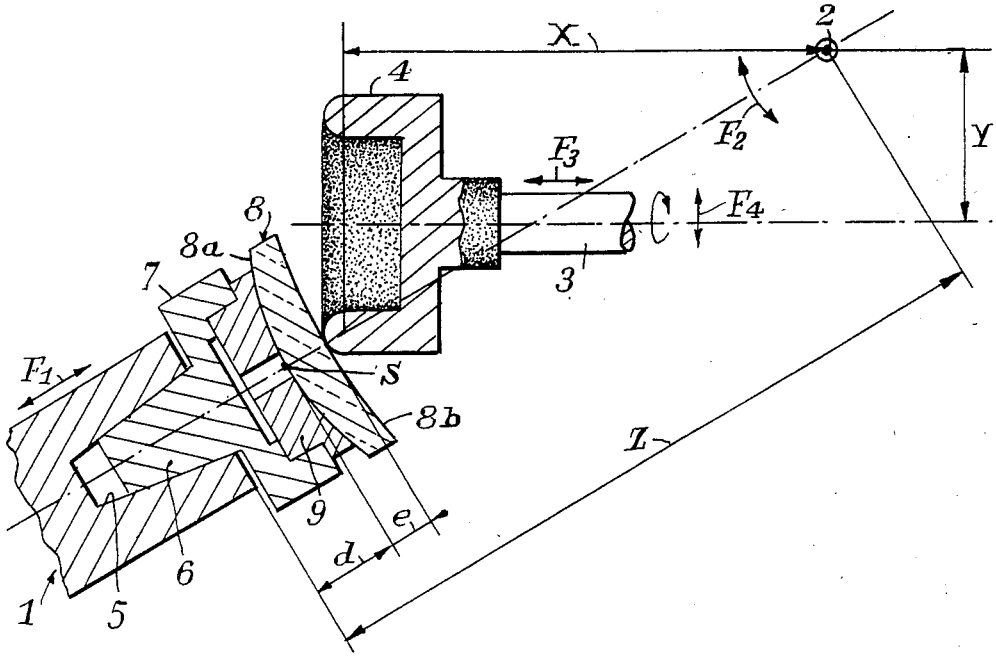
Fig. 1 PRIOR ART
FIG. 1 is a diagram which illustrates the operating principle of a known grinding machine.

The lens holding spindle 1 of the present invention, which has been described above, may be used in the grinding machine described in French Pat. No. 1,455,522 mentioned above, instead of the lens holding spindle 40 described in this French patent. To this end, the lens holding spindle 1 may be mounted and fixed, by its end portion 11*b*, in the support 36 shown in FIGS. 1, 2 and 5 of this French patent.

When it is desired to form a spherical or toric surface on face 8*b* of the ophthalmic lens 8, a metal block 9 is fixed on the finished face 8*a* of this lens and this block is fitted into recess 13 of sleeve 12 where it is held in position by suction. It will be noted that the metal block 9 comprises as usual a cylindrical hole 34 in its middle. In the prior art, this hole 34 was used for measuring the thickness at the center of the ophthalmic lens 8 with a micrometer calliper. With the holding spindle 1 of the present invention, part 11*a* of body 11 has an external diameter slightly smaller than the internal diameter of the cylindrical hole 34, so that it may be engaged therein.

Figure 2:
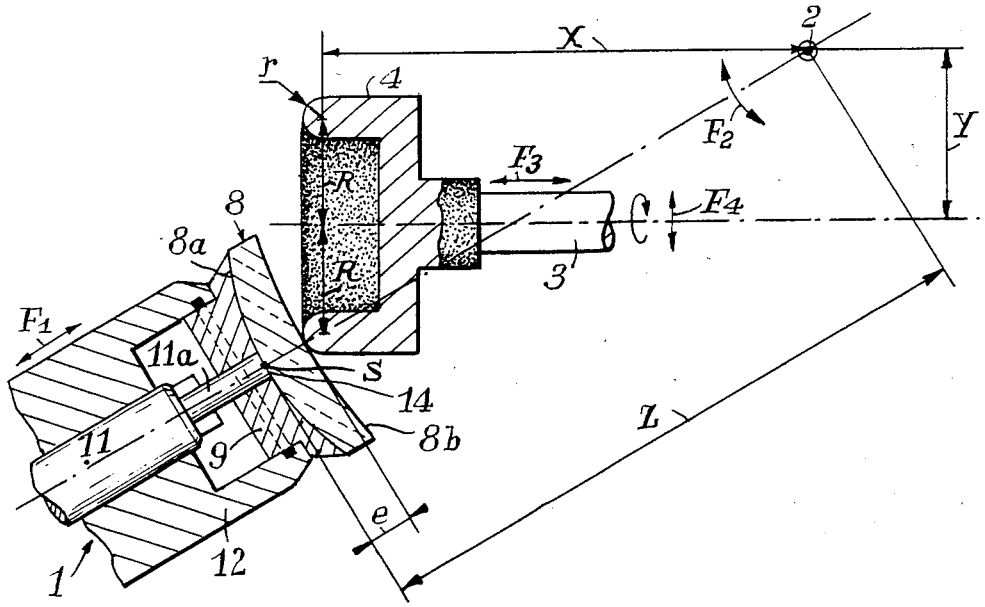
FIG. 2 is a diagram similar to that of FIG. 1, illustrating the operating principle of the known machine equipped with the lens holding spindle of the present invention, this spindle being only partially shown in FIG. 2.

After the metal block 9 has been fitted and held in recess 13 of sleeve 12, the operator pushes the ophthalmic lens 8 and sleeve 12, against the compression force of the two springs 15, until the apex S of face 8*a* of the ophthalmic lens 8 comes into contact with the end face 14 of end portion 11*a* of body 11 as shown in FIG. 2. At that moment, the operator actuates two jaws 21 and 22 by means of the pneumatic cylinder 23 so as to clamp the sleeve 12 with respect to body 11. Before grinding face 8*b* of the ophthalmic lens 8, the operator adjusts the three dimensions X, Y and Z. As in the prior art, dimensions X and Y may for example be provided by a calculator as a function on the one hand, of the radius or radii of curvature desired for face 8*b* (spherical or toric) of the opthalmic lens 8 and, on the other hand, on the shape and dimensions of grinding wheel 4 used. With the lens holding spindle 1 of the present invention, dimension Z may also be provided by the calculator as a function of the desired thickness e at the center of the ophthalmic lens 8, as a function of the dimensions (R and r) of the grinding wheel 4 and as a function of dimensions X and Y . In fact, as can be seen in FIG. 2, dimension Z is provided by the equation:

$$Z = e + r + \sqrt{X^2 + (R + Y)^2}$$

Since all the variables e, r, R, X and Y are perfectly known, the dimension Z required for obtaining the desired thickness e is then perfectly known and may therefore be adjusted directly by the operator without it being necessary to remove the ophthalmic lens 8 and to measure the thickness at its center between two grinding passes. Of course, if the amount of glass to be removed by grinding is too great to be removed in a single grinding pass, two grinding passes may of course be effected. However, even in this latter case, it is not necessary to remove the opthalmic lens 8 and to measure the thickness at its center between two grinding passes. In fact, it is sufficient, in the first stage, to adjust dimension Z to a value greater than that provided by the calculator and required for obtaining the desired thickness e for the ophthalmic lens 8, then to effect the first grinding pass and then, in the second stage, to adjust dimension Z to the value supplied by the calculator so as to obtain the desired thickness e during the second grinding pass.

With a lens holding spindle 1 of the present invention, the desired thickness e is obtained with an accuracy of the order of 1/100 th mm, whereas the grinding tolerances usually admitted for thickness e are + or − 1/10 mm.

Furthermore, this spindle can be used not only for manually controlled grinding machines but it is also particularly useful for digitally controlled grinding machines connected directly to a calculating and control computer.

Of course, the embodiment of the present invention which has been described above has been given by way of an example which is purely indicative and is in no wise limiting, and that numerous modifications may be readily made by a man skilled in the art without departing from the scope and spirit of the present invention. Thus, more especially, instead of being supported by body 11, jaws 21 and 22 could be supported by sleeve 12 and adapted to grip around the body 11. In another embodiment, the two jaws could be movable and disposed in diametrically opposite cavities formed in body 11 or in sleeve 12, and the actuating means could be adapted to move the jaws away from one an other and to clamp them against the inner bore of sleeve 12 or to bring the two jaws closer to one another and to clamp them against the outer surface of body 11 depending on whether the jaws are supported by body 11 or by sleeve 12.

What is claimed is:

1. A lens holding spindle for a lens grinding machine, comprising a substantially cylindrical body to be fixed to said lens grinding machine, a cylindrical sleeve slidably mounted on said cylindrical body for axial movement in relation thereto, said cylindrical sleeve having in a first end thereof a recess means for accommodating and holding therein a lens holding block fitted to a finished face of a lens, an opposite face of which is to be ground to a desired shape and to a predetermined thickness, as measured between apexes of the two faces of said lens, said lens holding block having a central hole registering with the apex of the finished face of the lens, said cylindrical body having a first end portion projecting axially into the recess of said sleeve, said first end portion of said cylindrical body being axially engageable into said central hole of said lens holding block and having an end face which forms both a fixed reference surface for defining the lens thickness and an axial bearing surface for the finished face of the lens when said cylindrical body is fixed to the grinding machine, when the lens and the lens holding block are fitted and held in the recess of said sleeve and when said sleeve is moved axially in one direction together with said lens holding block and said lens to bring the apex of the finished face into contact with the end face of the first end portion of said cylindrical body, and clamping means mounted on one of said cylindrical body and of said sleeve and operable, when actuated, to clamp the other of said cylindrical body and of said sleeve to prevent any relative axial movement between said sleeve and said cylindrical body when the apex of the finished face of the lens has been brought into contact with the end face of the first end portion of said cylindrical body.

2. The lens holding spindle as claimed in claim 1, further comprising a resilient means mounted between said cylindrical body and said sleeve for axially urging said sleeve towards a rest position in which said first end of said sleeve is off-set axially outwardly with respect to the end face of the first end portion of said cylindrical body, and stop means comprising a longitudinal slot, which is formed in one of said cylindrical body and of said sleeve, and a stop member, which is carried by the other of said cylindrical body and of said sleeve and which is engaged into said slot for limiting axial movement of said sleeve with respect to said cylindrical body under the urging action of said resilient means and for defining said rest position.

3. The lens holding spindle as claimed in claim 1, wherein said clamping means comprises two jaws which are carried by said cylindrical body and which are operable to grip said sleeve, and actuating means associated with said jaws for moving them towards one another.

4. The lens holding spindle as claimed in claim 3, wherein said cylindrical body has a second end portion which extends axially outwardly beyond a second end of said sleeve and which is provided with an external flange, a first one of said two jaws being rigidly fixed to said external flange.

5. The lens holding spindle as claimed in claim 4, wherein each of said two jaws has a substantially semi-cylindrical shape, two parallel guide rods have first ends thereof which are fixed to said first jaw, and extend at right angles to the longitudinal direction of said sleeve on opposite sides thereof, respectively, in a plane perpendicular to said longitudinal direction, a second one of said two jaws is mounted for sliding movement on said guide rods, and said actuating means comprises a pneumatic cylinder having a body which is fixed to second ends of said two guide rods, and a piston rod which bears on said second jaw substantially in the middle thereof.

6. The lens holding spindle as claimed in claim 4, wherein said sleeve comprises in its second end, an annular cylindrical cavity, said cylindrical body comprises a cylindrical collar which is integral with said external flange and which is slidingly engaged into said annular cavity of said sleeve, said collar and said annular cavity forming a labyrinth seal.

7. The lens holding spindle as claimed in claim 5, wherein a bellows has one end fixed to said two jaws and another end fixed to said sleeve.

8. The lens holding spindle as claimed in claim 1, wherein said cylindrical body comprises an axial passage having a first end which can be connected to a suction source and a second end which communicates with the recess of said sleeve through passages formed in said cylindrical body adjacent to the first end portion thereof, whereby said lens holding block can be held in the recess of said sleeve by the suction action of said suction source.

* * * * *